US006371389B1

(12) United States Patent
Bickart et al.

(10) Patent No.: US 6,371,389 B1
(45) Date of Patent: Apr. 16, 2002

(54) SPRAY NOZZLE WITH STATIC MEANS FOR INHIBITING OUTFLOW

(75) Inventors: Jean René Bickart, Satigny (CH); Pascal Meyer, Paris (FR)

(73) Assignee: Verbena Corporation N.V., An-Curacao (NL)

( * ) Notice: Subject to any disclaimer, the term of this patent is extended or adjusted under 35 U.S.C. 154(b) by 0 days.

(21) Appl. No.: 09/582,366

(22) PCT Filed: Dec. 22, 1998

(86) PCT No.: PCT/IB98/02101

§ 371 Date: Jun. 21, 2000

§ 102(e) Date: Jun. 21, 2000

(87) PCT Pub. No.: WO99/33572

PCT Pub. Date: Jul. 8, 1999

(30) Foreign Application Priority Data

Dec. 24, 1997 (FR) ..... 97 16748

(51) Int. Cl.[7] ..... B05B 1/34

(52) U.S. Cl. ..... 239/491; 239/493; 239/496; 239/463

(58) Field of Search ..... 239/491, 492, 239/493, 494–495, 496, 497, 463, 461

(56) References Cited

U.S. PATENT DOCUMENTS 4,020,979 A * 5/1977 Shay et al. ..... 239/492
5,547,132 A * 8/1996 Grogan ..... 239/492
5,738,282 A * 4/1998 Grogan ..... 239/492

* cited by examiner

*Primary Examiner*—David A. Scherbel
*Assistant Examiner*—Dinh Q. Nguyen
(74) *Attorney, Agent, or Firm*—William H. Eilberg

(57) ABSTRACT

The invention concerns a spray nozzle comprising a central swirl chamber (1) in which the fluid to be sprayed penetrates by tangential channels (7) producing a swirl axis perpendicular to the longitudinal axis (I—I). The fluid comes out of the swirl chamber (1) through a coaxial outlet passage (4). The nozzle comprises a rear coaxial recess (8) dimensioned and shaped so as to inhibit any residual outflow of fluid through the coaxial outlet passage (4) when the fluid supply is interrupted at the spray nozzle inlet (6).

11 Claims, 3 Drawing Sheets

SPRAY NOZZLE WITH STATIC MEANS FOR INHIBITING OUTFLOW

TECHNICAL FIELD OF THE INVENTION

The present invention concerns nozzles for spraying liquids, which can be used in the most diverse applications, for example spray pumps, evaporators, combustion burner nozzles, internal combustion engine injectors.

The invention applies more particularly to spray nozzles in which the liquid to be sprayed is fed into a central swirl chamber via lateral fluid inlet passages injecting the liquid tangentially, the liquid then leaving the central swirl chamber in an axial outlet direction through a coaxial outlet passage.

Document FR 2 324 986 describes a prior art spray nozzle. In this nozzle, the swirl chamber is conical, and the liquid is injected tangentially along the conical peripheral wall of the chamber in a forwardly oriented oblique direction. The outlet orifice has a rounded lip. A blind posterior coaxial recess is provided in the posterior wall of the swirl chamber, with a diameter less than that of the outlet orifice, to stabilize the spray cone at the exit from the nozzle.

Spray nozzles of the above kind with a central swirl chamber generally spray liquids well.

A problem which has been encountered, when using the above prior art nozzles is that, at the end of a spraying step, when the feed to the nozzle is interrupted, there is a residual outflow of fluid from the nozzle, in the form of one or more large droplets, which have not been sprayed.

In combustion applications, this leads to an increase in the level of carbon monoxide and in the level of hydrocarbons in the exhaust gases, and to soiling of the heat exchange walls, which reduces the transmission of heat and affects the efficiency of the installation.

One prior art solution consists in providing a valve at the inlet of the spray nozzle. This solution is costly, however, causes blocking and interferes with operation by introducing a threshold effect on starting. A valve of this kind also makes it essential to provide sufficient fluid pressures on the upstream side for it to operate correctly, which are significantly greater than the pressure needed for the nozzle itself to operate.

STATEMENT OF THE INVENTION

The problem addressed by the present invention is that of designing static, low-cost means of inhibiting outflow from the spray nozzle when its feed is interrupted.

The invention results from the surprising observation that, during operation of a spray nozzle with a central swirl chamber, if a swirl of liquid is formed in the swirl chamber in a plane generally perpendicular to the axis of the outlet orifice and if a posterior coaxial opening of sufficiently large diameter is provided, residual outflow from the nozzle is inhibited as soon as the feed of liquid to the nozzle is interrupted.

To this end, the invention provides a spray nozzle having:

- a central swirl chamber delimited by a peripheral wall with a shape of revolution about a longitudinal axis, an anterior wall incorporating a coaxial outlet passage, and a posterior wall,
- at least one lateral fluid inlet channel in the peripheral wall, opening into the central swirl chamber and shaped to inject the fluid tangentially into the swirl chamber,
- a posterior coaxial opening provided in the posterior wall of the swirl chamber.

Furthermore:

- the lateral fluid inlet passage(s) are shaped to inject the fluid into the swirl chamber in a direction substantially perpendicular to the longitudinal axis,
- the size and shape of the posterior coaxial opening inhibit any residual outflow of fluid via the coaxial outlet passage as soon as the fluid feed to the inlet of the spray nozzle is interrupted.

The posterior coaxial opening is preferably a shape of revolution about said longitudinal axis.

It has been found that good results for inhibiting residual outflow of liquid are obtained by providing a posterior coaxial opening having a diameter greater than the diameter of the coaxial outlet passage, more advantageously in the range from 1.2 times to twice the diameter of the coaxial outlet passage.

In practice, the width of the posterior coaxial opening can be in the range from the length of the coaxial outlet passage to five times that length.

Lengths which are too short do not inhibit residual outflow. Lengths which are too long do not have any apparent additional effect.

BRIEF DESCRIPTION OF THE DRAWINGS

Other objets, features and advantages of the present invention will emerge from the following description of particular embodiments of the invention, which is given with reference to the accompanying drawings, in which.

DESCRIPTION OF THE PREFERRED EMBODIMENTS

Figure 1:
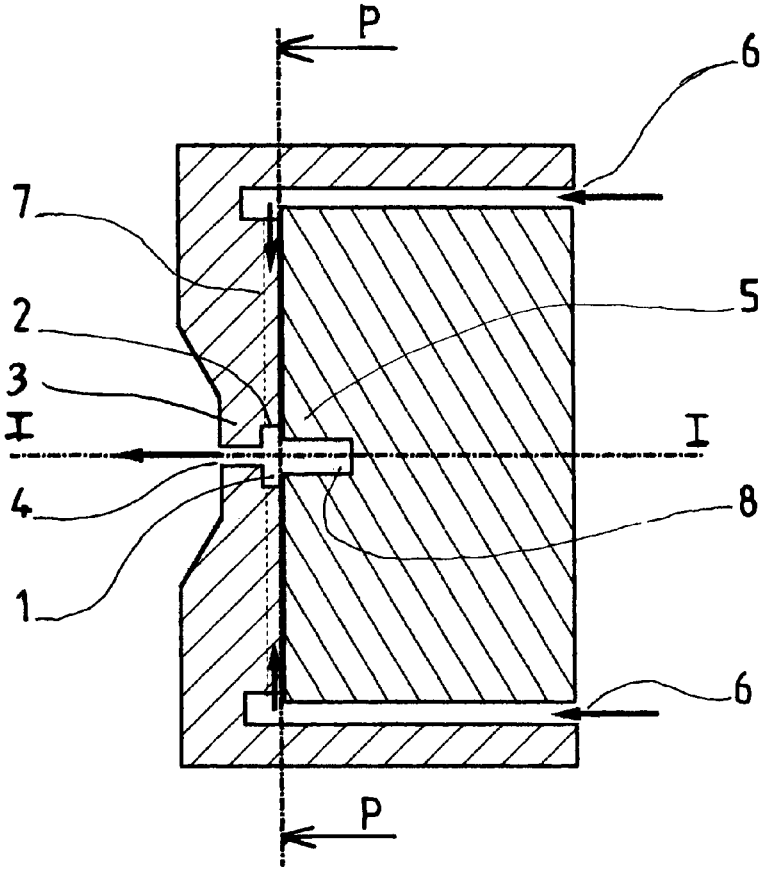
FIG. 1 is a partial side view in longitudinal section of one particular embodiment of a spray nozzle according to the invention.

In the embodiment of the invention shown in FIG. 1, a spray nozzle in accordance with the invention comprises a central swirl chamber 1 delimited by a peripheral wall 2 with a shape of revolution about a longitudinal axis I—I, an anterior wall 3 incorporating a coaxial outlet passage 4, and a posterior wall 5. The fluid is fed into the swirl chamber 1, from an outlet 6, via at least one lateral fluid inlet passage 7 formed in the peripheral wall 2, opening into the central swirl chamber 1, and shaped to inject the fluid tangentially into the swirl chamber 1 in a direction substantially perpendicular to the longitudinal axis I—I. A swirl of fluid is therefore produced in the swirl chamber 1 in a plane substantially perpendicular to the longitudinal axis I—I of the swirl chamber.

The posterior wall 5 of the swirl chamber 1 incorporates a posterior coaxial opening 8 whose size and shape are adapted to inhibit residual outflow of fluid via the coaxial outlet passage 4 as soon as the fluid feed to the inlet 6 of the spray nozzle is interrupted.

Figure 5:
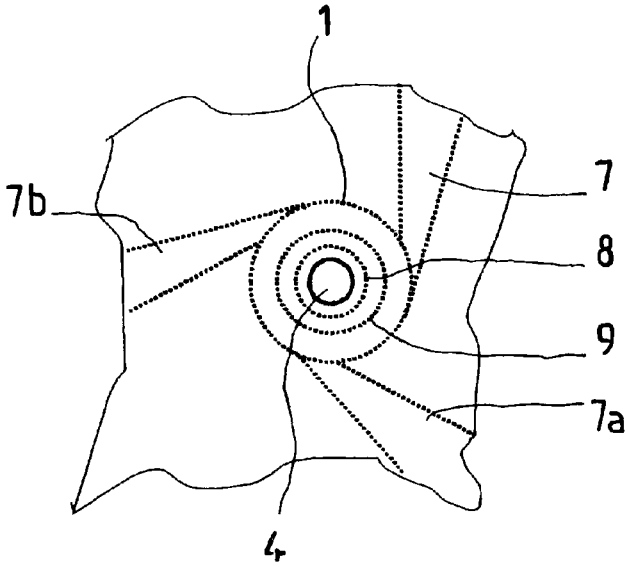
FIG. 5 is a front view to a larger scale of the swirl chamber area from FIG. 4.
Figure 4:
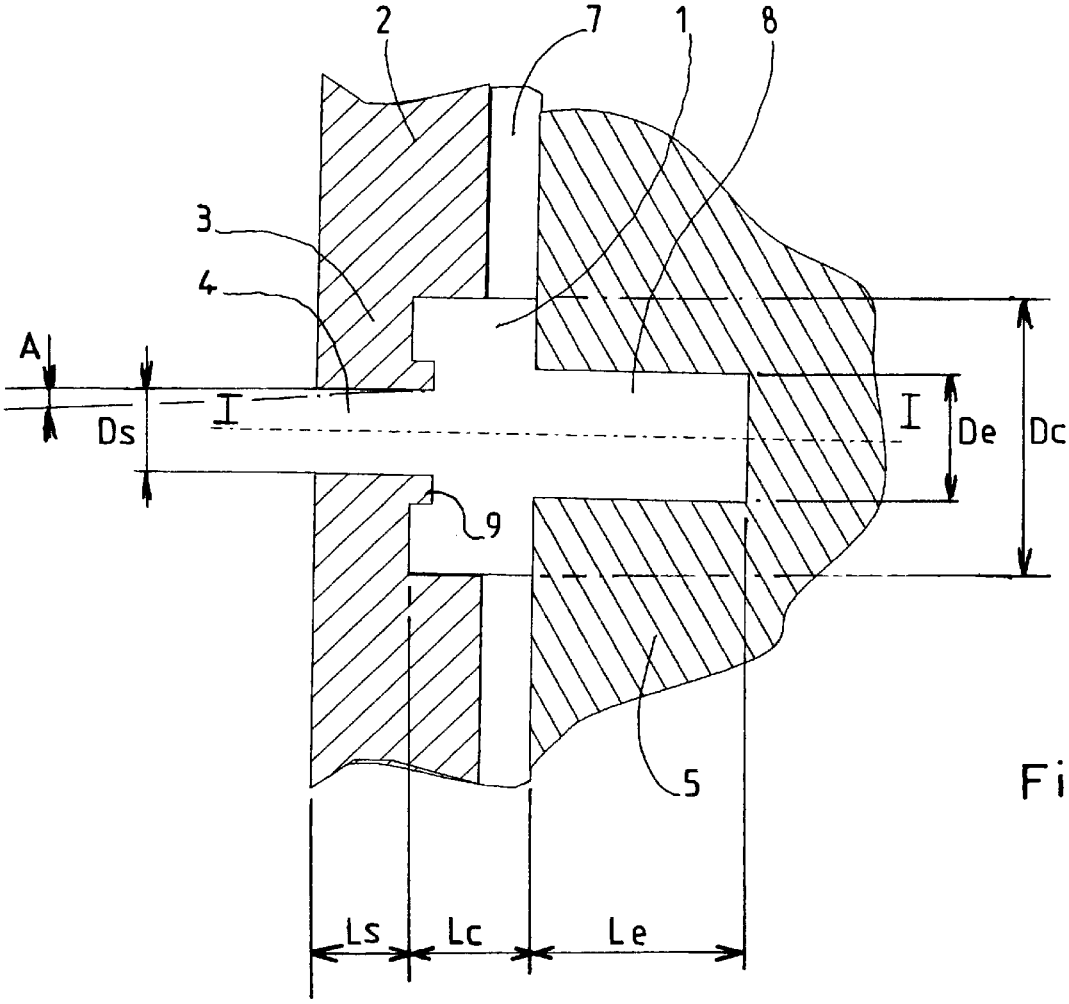
FIG. 4 is a side view in longitudinal section and to a larger scale showing a swirl chamber of one embodiment of the invention.

As can be seen more clearly in FIGS. 4 and 5 because of the larger scale, the posterior coaxial opening 8 is a shape of revolution about the longitudinal axis I—I. Its diameter De is greater than the diameter Ds of the coaxial outlet passage 4, and less than twice the value of said diameter Ds of the coaxial outlet passage 4.

When the spray nozzle is operating, the fluid enters via the tangential lateral passages such as the passage 7, forms a swirl in the swirl chamber 1 about the longitudinal axis I—I in a plane substantially perpendicular to said axis, and then leaves axially via the coaxial outlet passage 4.

It can be beneficial to choose a length Le for the posterior coaxial opening 8 which is just sufficient to obtain the required effect of inhibiting residual outflow, without limiting the length thereof, but with no excess length.

In practice, a length Le can generally be chosen which is between the length Ls of the coaxial outlet passage 4 and five times that length, preferably between four and five times that length.

By way of non-limiting example, satisfactory results have been obtained with spray nozzles in which Le is from 600 microns to 900 microns, Ls is approximately 250 microns and Ds is from 160 microns to 240 microns. These values are not limiting on the invention, as good results can be obtained outside the indicated limits.

The inhibition of residual outflow of liquid can be further improved by providing a posterior front annular rib 9 flanking the inlet of the coaxial outlet passage 4 in the swirl chamber 1, as seen more clearly in FIG. 4. A rib whose radial thickness and whose axial thickness are approximately 100 microns gives good results. Other values could be chosen according to the flow and liquid pressure conditions.

The coaxial outlet passage 4 is preferably frustoconical with a half-angle at the apex A from approximately 0° to approximately 3°, and converges towards the outlet, as shown in FIG. 4.

Figure 2:
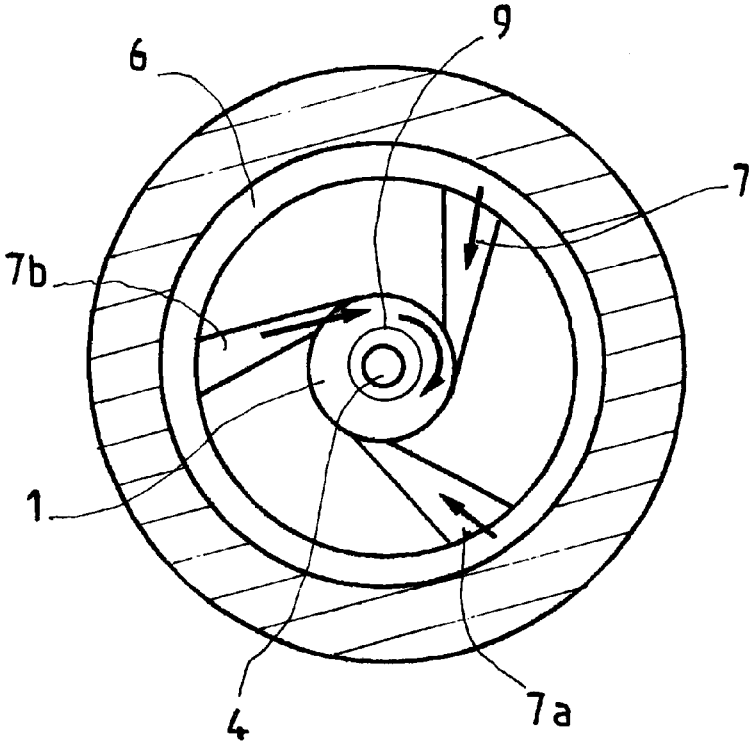
FIG. 2 is a view in cross section taken along the line P—P in FIG. 1.

The invention applies to a spray nozzle that can have various structures for swirling the fluid, that is to say having at least one tangential lateral fluid inlet passage 7. As shown in FIG. 2, a plurality of lateral inlet passages 7, 7*a* and 7*b* is preferably provided, regularly distributed at the periphery of the swirl chamber 1.

Figure 3:
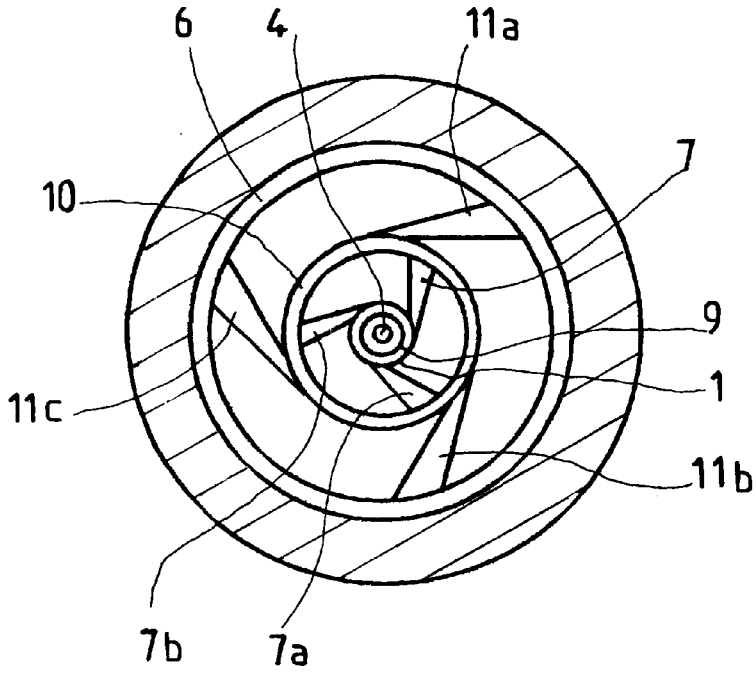
FIG. 3 is a view of another embodiment of a spray nozzle of the invention in cross section taken along the same line P—P.

The invention applies equally to spray nozzles with multi-stage inlet circuits, such as the one shown in FIG. 3, for example, in which the lateral inlet passages 7, 7*a* and 7*b* in the swirl chamber 1 extend from a common intermediate coaxial annular chamber 10 itself connected to the inlet 6 of the nozzle by a plurality of intermediate lateral passages such as the passages 11*a*, 11*b* and 11*c* injecting the fluid tangentially into the common intermediate coaxial annular chamber 10 so that the fluid rotates in the opposite direction to that in which it rotates in the swirl chamber 1.

Naturally the number of lateral inlet passages can be other than 1 or 3 or more, and the number of stages can be other than 1 or 2.

In the embodiment shown in FIG. 4, which gives good results, the diameter Dc of the swirl chamber 1 is greater than the length Lc of said swirl chamber 1.

The present invention is not limited to the embodiments which have been explicitly described, but includes variants and generalizations thereof within the scope of the following claims.

What is claimed is:

1. Spray nozzle having:

a central swirl chamber (1) delimited by a peripheral wall (2) with a shape of revolution about a longitudinal axis (I—I), an anterior wall (3) incorporating a coaxial outlet passage (4), and a posterior wall (5), the central swirl chamber having a diameter, at least one lateral fluid inlet channel (7) in the peripheral wall (2), opening into the central swirl chamber (1) and shaped to inject the fluid tangentially into the swirl chamber (1), a posterior coaxial opening (8) provided in the posterior wall (5) of the swirl chamber (1), the posterior coaxial opening having a diameter (De), wherein:

the diameter (De) of the posterior coaxial opening is less than the diameter of the central swirl chamber, the posterior coaxial opening comprises a blind hole, the lateral fluid inlet passages (7) are shaped to inject the fluid into the swirl chamber (1) in a direction substantially perpendicular to the longitudinal axis (I—I), and the size and shape of the posterior coaxial opening (8) inhibit any residual outflow of fluid via the coaxial outlet passage (4) as soon as the fluid feed to the inlet (6) of the spray nozzle is interrupted.

2. Spray nozzle according to claim 1, wherein the posterior coaxial opening (8) is a shape of revolution about the longitudinal axis (I—I).

3. Spray nozzle according to claim 1, wherein the diameter (De) of the posterior coaxial opening (8) is greater than the diameter (Ds) of the coaxial outlet passage (4), and less than twice the value of said diameter (Ds) of the coaxial outlet passage (4).

4. Spray nozzle according to claim 1, wherein the diameter (De) of the posterior coaxial opening (8) is in the range from 1.2 times to twice the value of diameter (Ds) of the coaxial outlet passage (4).

5. Spray nozzle according to claim 1, wherein the posterior coaxial opening (8) has a length (Le) close to its minimum value which is just sufficient to obtain the required effect of inhibiting residual outflow of liquid.

6. Spray nozzle according to claim 1, wherein the posterior coaxial opening (8) has a length (Le) between the length (Ls) of the coaxial outlet passage (4) and five times that length.

7. Spray nozzle according to claim 1, wherein a posterior frontal annular rib (9) flanks the inlet of the coaxial outlet passage (4) in the swirl chamber (1).

8. Spray nozzle according to claim 1, wherein the coaxial outlet passage (4) is frustoconical and converges towards the outlet and the half-angle at the apex (A) is in the range from approximately 0° to approximately 3°.

9. Spray nozzle according to claim 1, wherein it comprises a plurality of lateral inlet passages (7, 7*a*, 7*b*) regularly distributed at the periphery of the swirl chamber (1).

10. Spray nozzle according to claim 9, wherein the lateral inlet passages (7, 7*a*, 7*b*) extend from a common intermediate coaxial annular chamber (10) itself connected to the inlet (6) of the nozzle by a plurality of intermediate lateral passages (11*a*, 11*b*, 11*c*) injecting the fluid tangentially into the common intermediate coaxial annular chamber (10) so that the fluid rotates in the opposite direction to that in which it rotates in the swirl chamber (1).

11. Spray nozzle having:

a central swirl chamber (1) delimited by a peripheral wall (2) with a shape of revolution about a longitudinal axis (I—I), an anterior wall (3) incorporating a coaxial outlet passage (4), and a posterior wall (5), at least one lateral fluid inlet channel (7) in the peripheral wall (2), opening into the central swirl chamber (1) and shaped to inject the fluid tangentially into the swirl chamber (1), a posterior coaxial opening (8) provided in the posterior wall (5) of the swirl chamber (1), wherein:

the lateral fluid inlet passages (7) are shaped to inject the fluid into the swirl chamber (1) in a direction substantially perpendicular to the longitudinal axis (I—I), and the size and shape of the posterior coaxial opening (8) inhibit any residual outflow of fluid via the coaxial outlet passage (4) as soon as the fluid feed to the inlet (6) of the spray nozzle is interrupted, wherein a posterior frontal annular rib (9) flanks the inlet of the coaxial outlet passage (4) in the swirl chamber (1).

* * * * *